US005842561A

United States Patent [19]

Takahashi

[11] Patent Number: 5,842,561

[45] Date of Patent: Dec. 1, 1998

[54] PUSH-BUTTON SWITCH WITH BRIDGE SECTION INTEGRALLY CONNECTING MOVABLE CONTACT AND FIXED CONTACT

[75] Inventor: Kazunari Takahashi, Miyagi-ken, Japan

[73] Assignee: Alps Electric Co., Ltd., Tokyo, Japan

[21] Appl. No.: 778,326

[22] Filed: Jan. 2, 1997

[30] Foreign Application Priority Data

Jan. 12, 1996 [JP] Japan ..... 8-004170
Jan. 12, 1996 [JP] Japan ..... 8-004171

[51] Int. Cl.[6] ..... H01H 5/18

[52] U.S. Cl. ..... 200/406; 200/534

[58] Field of Search ..... 200/406, 534, 200/535, 302.2

[56] References Cited

U.S. PATENT DOCUMENTS 4,021,630 5/1977 Taylor ..... 200/302.2 X
5,055,642 10/1991 Miyata ..... 200/406 X
5,345,051 9/1994 Miike ..... 200/345
5,595,288 1/1997 Matsui et al. ..... 200/513

FOREIGN PATENT DOCUMENTS 2140623 11/1984 United Kingdom ..... 200/302.2

*Primary Examiner*—Renee S. Luebke
*Attorney, Agent, or Firm*—Guy W. Shoup

[57] ABSTRACT

A push-button switch including a housing which is integrally molded with a first metal plate and a second metal plate. The first metal plate includes a fixed contact, and the second metal plate includes a main portion, a bridge section extending from the main portion, and a bowl-shaped movable contact on a forward end of the bridge section. The housing is provided with a recess for exposing the fixed contact on the inner bottom face thereof, a plurality of caulking walls formed in an annular form around the recess, and gaps for relieving nonuniform thickening of the caulking walls which occurs at the time of caulking. The bridge section is folded such that the bowl-shaped movable contact covers the recess, and a peripheral edge portion of the movable contact is then fixedly caulked with the caulking walls.

6 Claims, 4 Drawing Sheets

PUSH-BUTTON SWITCH WITH BRIDGE SECTION INTEGRALLY CONNECTING MOVABLE CONTACT AND FIXED CONTACT

BACKGROUND OF THE INVENTION

1. Field of the Invention

The present invention relates to a push-button switch, such as a contact switch, in which a bowl-shaped movable contact (metal contact) operated by finger pressure is disposed to move to and from a fixed contact in a housing.

2. Description of the Related Art

As a push-button switch of the type stated above, a push-button switch of the constitution shown in FIG. 6 has been in wide use. That is, the prior art push-button switch is comprised primarily of a bottomed, box-type housing 3 formed by insert molding a first metal plate 1 and a second metal plate 2 thereinto, a bowl-shaped movable contact 4 located in a position where a recess 3*a* of the housing 3 is closed, and a flexible film 5 for preventing the entry of dust into the contact portion while restraining the upward movement of the movable contact 4. The first metal plate 1 is partly exposed as a fixed contact 6 on the inner bottom face of the recess 3*a*of the housing 3 and the second metal plate 2 being partly exposed on a movable contact mounting surface 3*b* of the housing 3 as to be in constant contact with the movable contact 4. The end portions of the first and second metal plates 1 and 2 serve as terminals not shown for external connection exposed on the outside surface of the housing 3.

The push-button switch thus constituted is mounted on a circuit substrate and then arranged below an unillustrated operating body. When pushed down by the finger or other through the operating body, the movable contact 4 that has been deflected by a specific stroke downward together with the flexible film 5 turns over to contact with the fixed contact 6, thereby allowing the switch circuit to switch from its OFF state to its ON state. Also, if the pressure of the finger is removed from the switch which is in its ON state, the movable contact 4 will move back to its original shape by its own elasticity, thus pushing the flexible film 5 upward and also moving away from the fixed contact 6 to set the switch circuit back to its OFF state.

When the prior art push-button switch described above is assembled, a process is needed such that after the bowl-shaped movable contact 4 is built in a specific position in the housing 3 which is formed integral with the first and second metal plates 1 and 2, the flexible film 5 is installed to the housing 3. This type of push-button switch is an extremely small type; each component being also small in size, it is imperative to decrease the number of component parts and the number of assembling processes to thereby reduce its cost.

Furthermore, in the aforesaid prior art push-button switch which is widespread, the height of the housing 3 has possibly been decreased for the purpose of decreasing the thickness of the push-button switch. In the push-button switch a bottom plate section has a sufficient thickness for embedding the metal plates 1 and 2 therein by the insert molding process and also has a space wide enough to install the bowl-shaped movable contact 4 thereabove. However, if the height of the housing 3 is decreased to the extent possible, the push-button switch can not be decreased in thickness more than that.

SUMMARY OF THE INVENTION

It is, therefore, an object of the present invention to provide a push-button switch which enables caulking to a housing the peripheral edge portion of a movable contact preformed on a metal plate to be integrally formed at the time of molding of the housing, and further pressing to joint the extended portion of the movable contact to an electrically conductive portion exposed into a groove in the housing, thereby enabling dispensing with a separate movable contact and a flexible film used in the prior art push-button switch, decreasing the number of component parts and the number of assembling processes, and reducing the thickness of the push-button switch.

A first push-button switch of the present invention comprises a first metal plate having a fixed contact, a second metal plate including a main portion, a bridge section extending from the main portion, and a bowl-shaped movable contact formed at a forward end of the bridge section; and a housing which is integrally molded with the first and second metal plates such that the movable contact protrudes outwardly, wherein the housing is provided with a recess having a peripheral edge and a bottom inner surface through which the fixed contact is exposed, and caulking walls formed around the peripheral edge of the recess. The bridging section is folded such that the movable contact covers the recess, and the peripheral edge portion of the movable contact is securely caulked with the caulking walls. According to the constitution stated above, the housing and the movable contact are formed in one body beforehand, and therefore it becomes unnecessary to install a separate movable contact. Moreover, since the caulking walls position and secure the movable contact, it becomes unnecessary to cover the movable contact with a flexible film, and therefore it is possible to largely decrease the quantity of component parts and the number of assembling processes.

In addition to the above-described constitution, a plurality of aforesaid caulking walls are arranged in an annular form around the recess, and also a gap is provided for relieving nonuniform thickening between adjacent caulking walls likely to occur at the time of caulking, thereby enabling reliable caulking over nearly the entire peripheral edge portion of the movable contact. There is, therefore, little possibility of entrance of foreign substances, such as dust, into the recess covered with the movable contact.

Furthermore, in a second push-button switch of the present invention, a housing defining a recess having a peripheral edge and an inner bottom surface through which a fixed contact is exposed and a groove formed adjacently to the peripheral edge of the recess with an electrically conductive portion exposed to the inner bottom surface thereof, the recess being covered with a bowl-shaped movable contact, the movable contact being fixedly caulked at the peripheral edge portion thereof to the housing, and an extended portion extending from the movable contact which is disposed within the groove being pressed into contact with the electrically conductive section. Adopting the push-button switch of the above-described constitution can hold the movable contact in its ON state relative to the electrically conductive portion by positioning the movable contact in the housing by a relatively simple caulking procedure. It, therefore, becomes unnecessary to cover the movable contact with a flexible film.

In addition to the above-described constitution, the provision of a projection on at least either one of the electrically conductive portion and the extended portion can easily improve the reliability of contact between these two parts.

Further in addition to the above-described constitution, a metal plate molded integrally with the housing and having the electrically conductive portion is partly protruded out of the housing and folded back to provide a folded portion, which is then cut off to thereby form beforehand the extended portion and the movable contact from the metal plate as one body with the housing. It is therefore possible to further decrease the number of component parts.

The above and other objects, features and advantages of the present invention will become apparent from the following description and the appended claims taken in conjunction with the accompanying drawings.

DESCRIPTION OF THE PREFERRED EMBODIMENTS

Figure 1A:
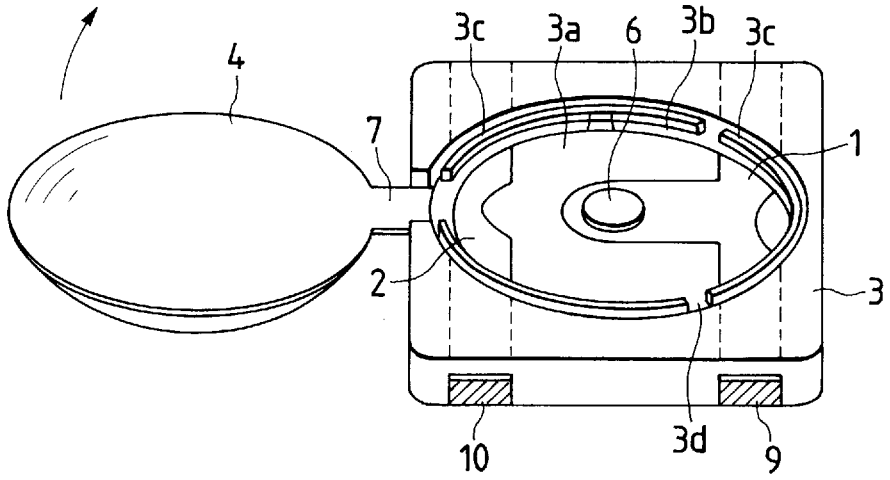
FIGS. 1A, 1B and 1C are explanatory views showing a procedure for assembling a first embodiment of a push-button switch according to the present invention.
Figure 1B:
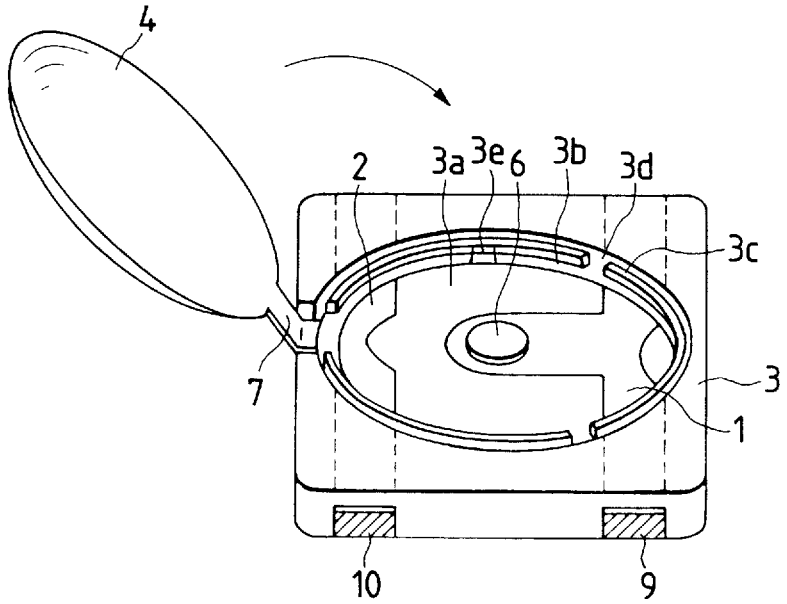
Figure 6:
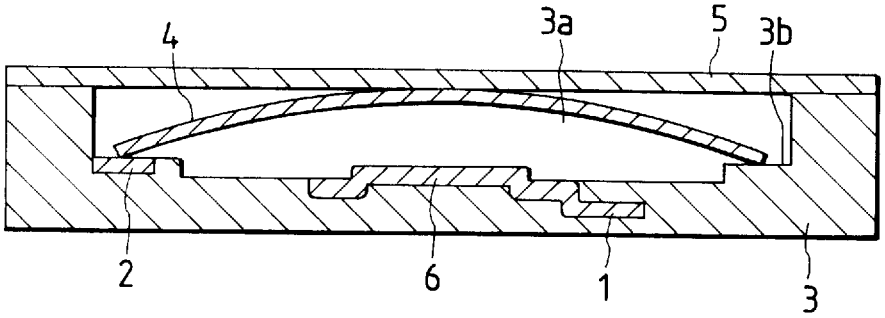
FIG. 6 PRIOR ART
FIG. 6 is a sectional view showing an example of a conventional push-button switch.

One preferred embodiment of a first push-button switch according to the present invention will hereinafter be described with reference to FIGS. 1 to 3. FIG. 1 is an explanatory view showing the assembling procedure of the first embodiment; FIG. 2 is a sectional view of the same embodiment after assembling; and FIG. 3 is a plan view showing the push-button switch in a hoop state after insert molding in the process of manufacture of the same embodiment; in these drawings the same parts or elements as those of the prior art shown in FIG. 6 are designated by the same reference numerals.

Figure 1C:
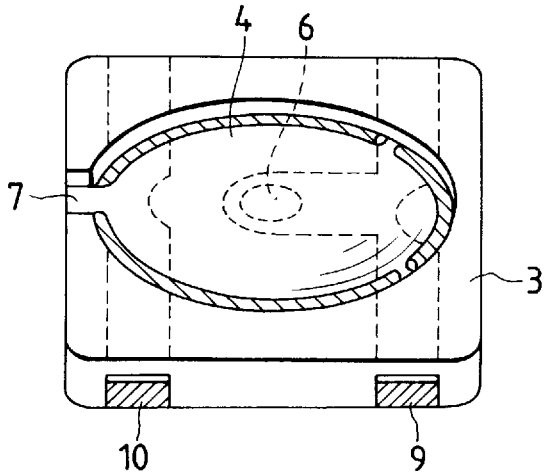
Figure 2:
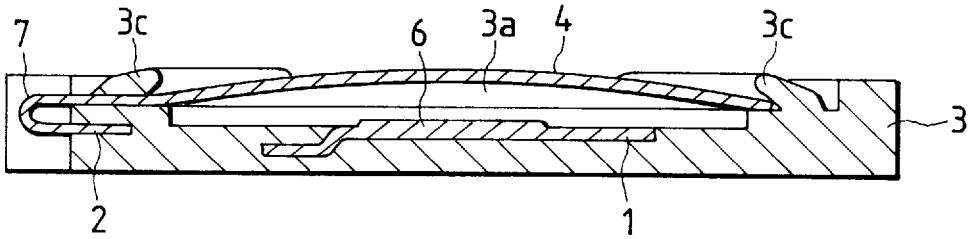
FIG. 2 is a sectional view of the first embodiment of the push-button switch after assembling.

The push-button switch shown in FIGS. 1C and 2 is manufactured through later-described folding and caulking processes after molding a bottomed box-type housing 3, by inserting a first metal plate 1 having a fixed contact 6 and a second metal plate 2, having a bowl-shaped movable contact 4 mounted at the forward end of a bridge section 7 extending perpendicularly from a main portion, into a mold. The housing 3 is provided with a recess 3*a* in which the fixed contact 6 is exposed on an inner bottom face thereof, a movable contact mounting surface 3*b* formed in an annular form around the recess 3*a*, and a plurality of caulking walls 3*c* formed in an annular form around the mounting surface 3*b*. That is, the housing 3 of this push-button switch is molded with a part of the bridge section 7 and the movable contact 4 of the second metal plate 2 protruded outwardly; after insert molding, first is partly folded back as shown in FIGS. 1A and 1B, thus causing the movable contact 4 to cover the recess 3*a* with the movable contact 4 mounted on the movable contact mounting surface 3*b* of the housing 3. Subsequently the caulking walls 3*c* of the housing 3 are buckled to the inner peripheral side by using an unillustrated 45-degree tapered caulking punch to thereby securely caulk nearly the entire peripheral edge portion of the movable contact 4 mounted on the movable contact mounting surface 3*b*, thus completing the assembling operation.

The housing 3 of the push-button switch is provided with a gap 3*d* between adjacent caulking walls 3*c* for relieving nonuniform thickening of the caulking walls 3*c* occurring at the time of caulking. Also, in specific positions of the movable contact mounting surface 3*b* and caulking walls 3*c* of the housing 3, there are provided relief grooves 3*e* serving as air passages between them, and therefore there will occur no difference in air pressure between the switch interior and the outside space notwithstanding a change in space volume in the recess 3*a* covered with the movable contact 4.

Figure 3:
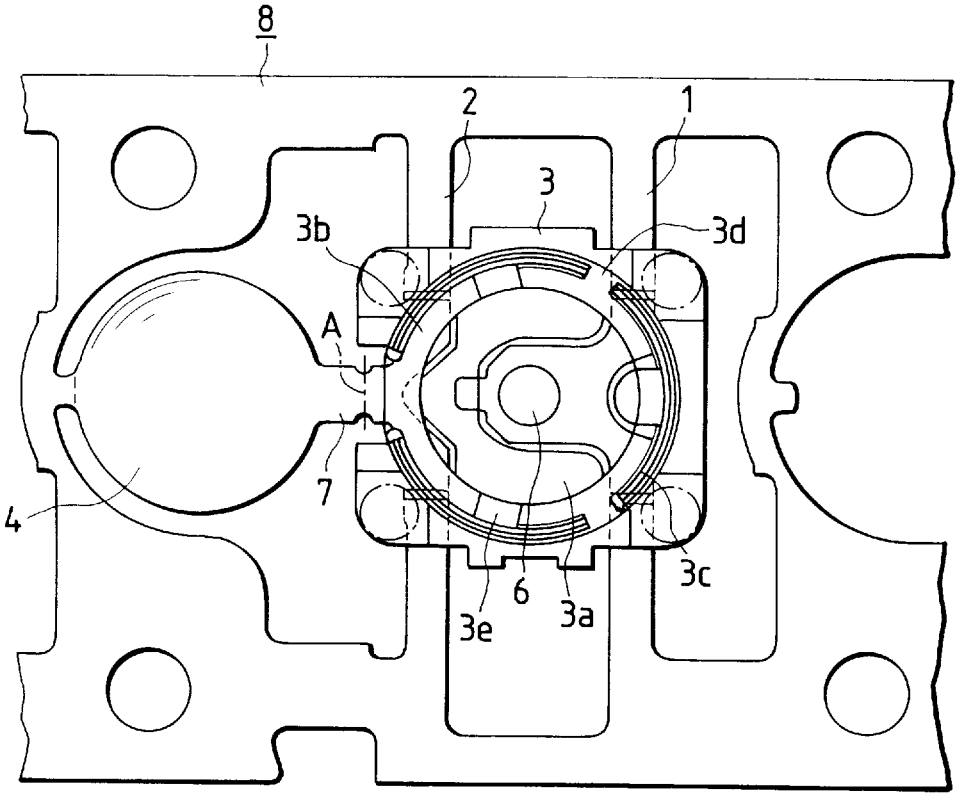
FIG. 3 is a plan view showing the push-button switch in a hoop state after insert molding in the manufacturing process of the present embodiment.

The first and second metal plates 1 and 2 formed integrally with the housing 3 are made by cutting off a common hoop 8 after insert molding as seen from FIG. 3. The ends of the metal plates 1 and 2 which are thus made electrically independent serve as terminals 9 and 10 for external connection which are exposed to the outside wall surface of the housing 3. In FIG. 3, the chain line A indicates the folding part of the bridge section 7.

The push-button switch thus constituted is mounted on a circuit substrate and disposed beneath an operating member (not shown). When the movable contact 4 is depressed by a finger through the operating member, the movable contact 4 which has deflected downwardly by a specific stroke turns back into contact with the fixed contact 6, thereby switching the switch circuit from its OFF state to its ON state. When the pressure of the finger is removed in its ON state, the movable contact 4 recovers the original form by its own resilience; thus moving away from the fixed contact 6 to thereby open the switch circuit.

According to the first embodiment, the push-button switch is built by folding the bridge section 7 to cover the recess 3*a* by the movable contact 4 after performing insert molding so that a part of the bridge portion 7 and the movable contact 4 of the second metal plate 2 will protrude outwardly of the housing 3, then by caulking the peripheral edge portion of the movable contact 4 with the caulking walls 3*c*. Since the housing 3 and the movable contact 4 are preformed in one body, it is unnecessary, unlike the conventional push-button switch, to build a separate movable contact. Furthermore since the movable contact 4 is positioned and fixed by the buckled caulking walls 3*c* to prevent its dislocation, a flexible film that has been used in the conventional push-button switch is not needed. Consequently, the push-button switch of the present invention uses a largely decreased number of component parts and accordingly requires a less number of assembling processes as compared with conventional products. Moreover development of thin push-button switches has been promoted because of the realization of the same amount of decrease in overall height as the thickness of a flexible film.

In the present embodiment, the housing 3 is provided with the plurality of caulking walls 3*c* arranged in an annular form around the recess 3*a*, and the gap 3*d* is formed in advance between adjacent caulking walls 3*c* to thereby relieve nonuniform thickening at the time of caulking. Since nearly the entire periphery of the movable contact 4 can be securely caulked, there is little possibility of entrance of foreign substances, such as dust, into the recess 3*a* covered with the movable contact 4, thus ensuring the provision of a highly reliable contact section.

According to the first embodiment, the housing 3 has the relief grooves 3*e* in specific places, so that there will occur no air pressure difference between the switch interior and the outside space if there has occurred any change in the volume of space within the recess 3*a* covered with the movable contact 4, and accordingly the deflection of the movable contact 4 will not be adversely affected by the air pressure difference during the depression of the switch.

As in the present embodiment, a sufficient caulking force can easily be obtained for fixedly caulking the movable contact 4 in position without reducing its spring characteristic, by buckling the caulking walls 3*c* of the housing 3 by the use of a 45-degree tapered caulking punch. That is, if a 30-degree tapered caulking punch were used in the above-described push-button switch caulking process, the caulking walls 3*c* would fail to buckle enough toward the inner periphery, and therefore the movable contact 4 would be caulked with a low, unstable caulking force. Furthermore, if a 60-degree tapered caulking punch were used, the caulking walls 3*c* would be largely buckled toward the inner periphery, and the peripheral edge portion of the movable contact 4 would be excessively caulked, giving an adverse effect to the spring characteristic of the movable contact 4 and consequently resulting in a malfunction of the push-button switch.

Figure 4:
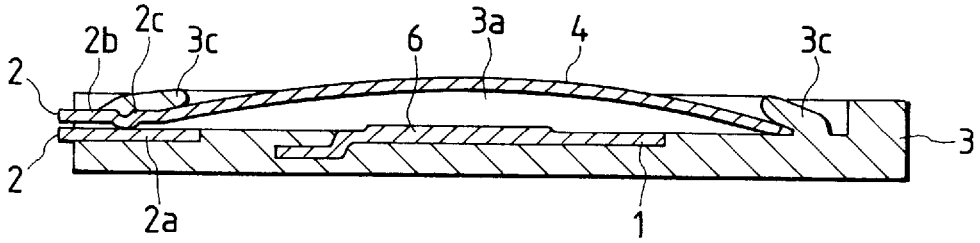
FIG. 4 is a sectional view of a second embodiment of a push-button switch according to the present invention after assembling.

A second embodiment of a second push-button switch according to the present invention will further be explained with reference to FIGS. 4 and 5, in which FIG. 4 is a sectional view of the second embodiment after assembling, and FIG. 5 is an explanatory view showing the assembling procedure of the same embodiment. It should be noted that the same parts or elements as those in FIG. 6 are designated by the same reference numerals.

Figure 5A:
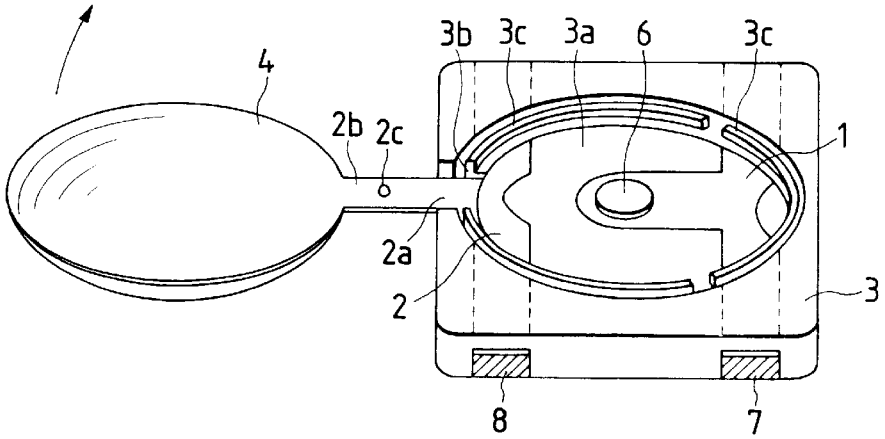
FIGS. 5A, 5B and 5C are explanatory views showing a procedure for assembling the embodiment of the push-button switch.
Figure 5B:
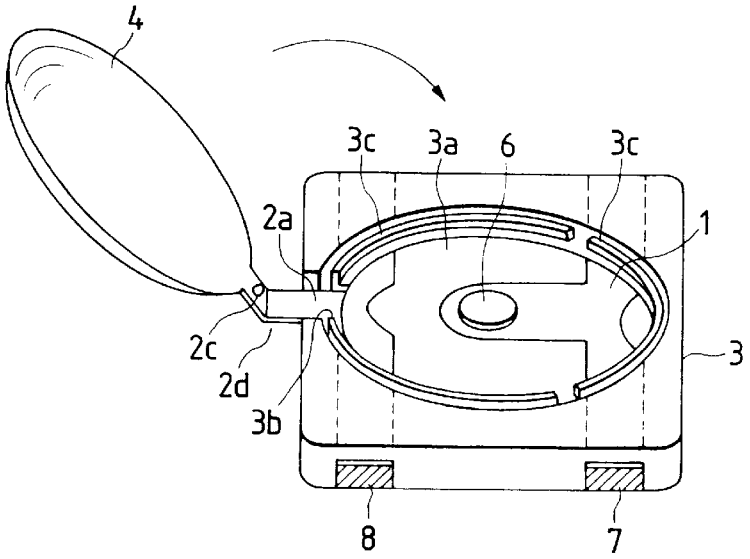
Figure 5C:
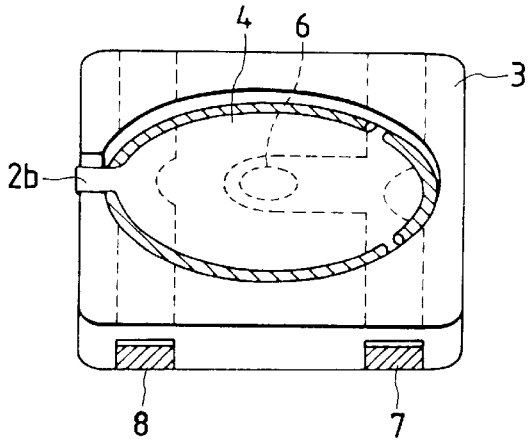

The push-button switch shown in FIGS. 4 and 5C is made through later-described folding, caulking, and cutting processes, after insert molding of a bottomed box-type housing 3, by inserting into a mold a first metal plate 1 having a fixed contact 6 and a second metal plate 2 having an electrically conductive portion 2*a* and a bowl-shaped movable contact 4 at the forward end of its extended portion 2*b*. The housing 3 is provided with a recess 3*a* with the fixed contact 6 exposed to the inner bottom face thereof, a groove 3*b* cut in the side of the recess 3*a* with the electrically conductive portion 2*a* exposed on the inner bottom face, and caulking walls 3*c* formed in an annular form around the recess 3*a*. Of the second metal plate 2, the movable contact 4 is secured to the housing 3 by caulking the peripheral edge thereof with the caulking walls 3*c* of the housing; and the extended portion 2*b* extending sideward of the movable contact 4 is pressed into contact with the electrically conductive portion 2*a* within the groove 3*b* of the housing 3. The extended portion 2*b*, however, is not in surface contact with the electrically conductive portion 2*a*, but a projection 2*c* preformed on the extended portion 2*b* is in local contact with the electrically conductive portion 2*a*.

That is, the housing 3 of this push-button switch is molded with at least the extended portion 2*b* and movable contact 4 of the second metal plate 2 projected outwardly, and after the insert molding, a folded portion 2*d* connecting the electrically conductive portion 2*a* and the extended portion 2*b* is folded first as shown in FIGS. 5A and 5B to thereby hold the movable contact 4 in a position in which the recess 3*a* of the housing 3 is covered. Subsequently, the caulking walls 3*c* of the housing 3 are buckled to the inner periphery side by the use of a caulking punch not shown; the peripheral edge portion of the movable contact 4 is securely caulked all around, and thereafter, of the second metal plate 2 the folded portion 2*d* protruding to the side of the housing 3 is cut off, thus completing the assembling operation.

The first and second metal plates 1 and 2 which are molded integrally with the housing 3 are produced by separating a common hoop material after insert molding. The ends of the thus electrically independent metal plates 1 and 2 serve as terminals 7 and 8 for external connection which are exposed to the outside wall surface of the housing 3.

The push-button switch thus constructed is mounted on a circuit substrate, and is disposed under an operating body (not shown). The movable contact 4, when depressed from above by a finger through the operating body, deflects downwardly by a predetermined stroke and then turns back into contact with the fixed contact 6, thus operating the switch circuit from its OFF state to its ON state. When the finger pressure is removed from the push-button switch in its ON state, the movable contact 4 resets to its original form with the resilience of its own, moving away from the fixed contact 6 to set the switch circuit back to its OFF state.

In the present second embodiment, the push-button switch is of such a constitution that the movable contact 4 covering the recess 3*a* of the housing 3 is fixedly caulked at the peripheral edge portion thereof by the housing 3, and the extended portion 2*b* extending to the side of the movable contact 4 is pressed into contact with the electrically conductive portion 2*a* which is exposed in the groove 3*b* of the housing 3. The movable contact 4 can be held conductive to the electrically conductive portion 2*a* simply by fixedly positioning the movable contact 4 to the housing 3 by a relatively simple caulking procedure. It is, therefore, unnecessary to cover the movable contact with a flexible film used in the conventional push-button switch. Moreover, in the push-button switch the projection 2*c* formed in advance in the extended portion 2*b* is pressed in contact with the electrically conductive portion 2*a*; therefore the extended portion 2*b* reliably contacts with the electrically conductive portion 2*a* by caulking the peripheral edge portion of the movable contact 4, ensuring good continuity between the extended portion 2*b* and the electrically conductive portion 2*a*.

Furthermore, in the present second embodiment, the second metal plate 2 formed integrally with the housing 3 by insert molding not only has the electrically conductive portion 2*a* but has the movable contact 4 and the extended portion 2*b* protruding outwardly of the housing 3 at the time of molding, and the protruding portion is folded so that the movable contact 4 can move into contact with, and away from, the fixed contact 6. Unlike the conventional push-button switch, therefore, it is unnecessary to install a separate movable contact. Consequently, in the push-button switch of the present invention, the number of component parts and the number of assembling processes have largely been decreased as compared with the conventional products. In addition, the development of thin type push-button switches has been promoted because of the overall height of the push-button switch that has been decreased by the same amount as the thickness of a flexible film.

It should be noticed that in the present embodiment described above, the push-button switch is provided with the projection 2*c* in the extended portion 2*b* for the purpose of enhancing the reliability of contact with the electrically conductive portion 2*a*, but much the same effect is obtainable by providing the electrically conductive portion 2*a* with a similar projection.

Furthermore, in the example of the above-described embodiment, the second metal plate 2 having the electrically conductive portion 2*a* is used for integrally mold the extended portion 2*b* and the movable contact 4; the movable contact 4, however, may be caulked after installing in the housing 3 a movable contact provided with an extended portion formed of a metal plate separately from the metal plate 2. In this case, the number of component parts increases as compared with the aforementioned embodiment, but the folding process and the cutting process can be dispensed with.

In the push-button switch of the present invention, as described hereinabove, the movable contact is preformed on the metal plate which is formed integrally with the housing at the time of molding, and the peripheral edge portion of the movable contact is caulked by the caulking walls of the housing. Therefore a movable contact as a separate part and a flexible film used in the conventional products can be dispensed with. The push-button switch of the present invention, therefore, has such a great advantage that the number of component parts and the number of assembling processes can be decreased, thereby realizing the reduction in overall thickness of the push-button switch. The plurality of caulking walls are arranged in an annular form around the recess of the housing with the fixed contact exposed to the inner bottom face, and the gap is provided between adjacent caulking walls to relieve nonuniform thickening likely to occur at the time of caulking, thereby ensuring reliable caulking through the entire peripheral edge portion of the movable contact, reducing the possibility of entrance of foreign substances, such as dust, into the recess covered by the movable contact, and obtaining a high-reliability contact section.

Furthermore, since, in the push-button switch of the present invention, the peripheral edge portion of the movable contact is fixedly caulked by the housing and the extended portion of the movable contact is pressed to the electrically conductive portion exposed into the groove of the housing, a flexible film used in the conventional products can be dispensed with and the number of component parts and the number of assembling processes can be reduced to thereby enable to decrease the thickness of the push-button switch. Furthermore, it is possible to easily enhance the contact reliability between the electrically conductive portion and the extended portion by providing a projection on at least one of these portions. Furthermore, integrally forming the extended portion and the movable contact in a metal plate having the electrically conductive portion molded integrally with the housing can form beforehand the housing and the movable contact as one body, thereby enabling the disuse of a separate movable contact and further the reduction in the number of component parts.

While preferred embodiments of the present invention are shown and described hereinabove, it will be understood that the invention is not to be limited thereto, since many modifications and changes may be made therein, and it is contemplated therefore, by the appended claims, to cover any such modifications as fall within the true spirit and scope of this invention.

What is claimed is:

1. A push-button switch, comprising:

a first metal plate having a fixed contact;

a second metal plate including a main portion, a bridge section extending from the main portion, and a bowl-shaped movable contact formed at a forward end of the bridge section; and a housing which is integrally molded with said first and second metal plates such that said movable contact protrudes outwardly, wherein said housing is provided with a recess having a peripheral edge and a bottom inner surface through which said fixed contact is exposed, and caulking walls formed around the peripheral edge of said recess, wherein said bridging section is folded such that said movable contact covers said recess, and wherein a peripheral edge portion of said movable contact is securely caulked with said caulking walls.

2. A push-button switch according to claim 1, wherein the caulking walls are arranged in an annular form around the peripheral edge of said recess, and a gap for relieving nonuniform thickening likely to occur at the time of caulking is provided between adjacent caulking walls.

3. A push-button switch, comprising:

a housing defining a recess having a peripheral edge and an inner bottom surface through which a fixed contact is exposed and a groove formed adjacently to the peripheral edge of said recess with an electrically conductive portion exposed to the inner bottom surface thereof, said recess being covered with a bowl-shaped movable contact, said movable contact being fixedly caulked at the peripheral edge portion thereof to said housing, and an extended portion extending from said movable contact which is disposed within said groove being pressed into contact with said electrically conductive section.

4. A push-button switch according to claim 3, wherein at least one of said electrically conductive portion and said extended portion is provided with a projection.

5. A push-button switch according to claim 4, wherein a metal plate having said electrically conductive portion integrally molded with said housing is partly protruded outwardly of said housing and folded, and then the folded portion is cut off to thereby form said extended portion and said movable contact from said metal plate.

6. A push-button switch according to claim 3, wherein a metal plate having said electrically conductive portion integrally molded with said housing is partly protruded outwardly of said housing and folded, and then the folded portion is cut off to thereby form said extended portion and said movable contact from said metal plate.

* * * * *